United States Patent [19]

Hasegawa et al.

[11] Patent Number: 4,509,489

[45] Date of Patent: Apr. 9, 1985

[54] FUEL SUPPLY CONTROL METHOD FOR AN INTERNAL COMBUSTION ENGINE, ADAPTED TO IMPROVE OPERATIONAL STABILITY, ETC., OF THE ENGINE DURING OPERATION IN PARTICULAR OPERATING CONDITIONS

[75] Inventors: Shumpei Hasegawa, Niiza; Yutaka Otobe, Shiki; Noriyuki Kishi, Itabashi; Takashi Koumura, Iruma, all of Japan

[73] Assignee: Honda Giken Kogyo Kabushiki Kaisha, Tokyo, Japan

[21] Appl. No.: 502,129

[22] Filed: Jun. 8, 1983

[30] Foreign Application Priority Data

Jun. 11, 1982 [JP] Japan ..... 57-100440

[51] Int. Cl.[3] ..... F02M 51/00

[52] U.S. Cl. ..... 123/489

[58] Field of Search ..... 123/440, 478, 489

[56] References Cited

U.S. PATENT DOCUMENTS

| | | | |
|---|---|---|---|
| 4,321,903 | 3/1982 | Kondo et al. | 123/489 |
| 4,329,960 | 5/1982 | Woodhouse et al. | 123/489 |
| 4,348,727 | 7/1982 | Kobayashi et al. | 123/489 |
| 4,385,613 | 5/1983 | Yoshida et al. | 123/489 |
| 4,419,975 | 12/1983 | Kubota et al. | 123/489 |

*Primary Examiner*—Parshotam S. Lall
*Assistant Examiner*—W. R. Wolfe
*Attorney, Agent, or Firm*—Lyon & Lyon

[57] ABSTRACT

A fuel supply control method for electronically controlling the air/fuel ratio supply to an engine, in response to the output from means for detecting concentration of an ingredient in exhaust gases from the engine. When the engine is in a feedback control region, the air/fuel ratio control is effected by the use of a first coefficient, the value of which is variable in response to the output from the exhaust gas ingredient concentration detecting means, while simultaneously a mean value of values of the first coefficient applied during the feedback control operation is calculated for use as a second coefficient. The second coefficient and a predetermined value are used for control of the air/fuel ratio, in place of the first coefficient, respectively, when the engine is in a first one of the particular operating regions and when the engine is in a second one of same. Preferably, when there is a transition of the operating condition of the engine from one of the particular operating regions to the feedback control region, the air/fuel ratio control is initiated by the use of a second predetermined value other than the above predetermined value, preferably the above second coefficient, in place of the first coefficient. Further, preferably, when the engine is in an idling region as the above second particular operating region, the air/fuel ratio is further corrected by a correction variable corresponding to a preset voltage supplied from a variable voltage creating means.

12 Claims, 10 Drawing Figures

| FIG. 3A | FIG. 3B |
|---|---|

FUEL SUPPLY CONTROL METHOD FOR AN INTERNAL COMBUSTION ENGINE, ADAPTED TO IMPROVE OPERATIONAL STABILITY, ETC., OF THE ENGINE DURING OPERATION IN PARTICULAR OPERATING CONDITIONS

BACKGROUND OF THE INVENTION

This invention relates to a fuel supply control method for electronically controlling the air/fuel ratio of an air/fuel mixture being supplied to an internal combustion engine, and more particularly to a fuel supply control method of this kind, which is adapted to apply air/fuel ratio control coefficients for control of the air/fuel ratio in a manner such that the values of such coefficients are set to respective suitable values while the engine is operating in a plurality of particular operating regions, so as to control the air/fuel ratio to predetermined desired values or values close thereto in these particualr operating regions, thereby improving the operational stability of the engine as well as the driveability of same.

A fuel supply control system adapted for use with an internal combustion engine, particularly a gasoline engine has been proposed e.g. by Japanese Patent Provisional Publication (Kokai) No. 57-210137, which is adapted to determine the fuel injection period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

According to this proposed fuel control system, while the engine is operating in a normal operating condition, the air/fuel ratio is controlled in feedback mode such that the valve opening period of the fuel injection device is controlled by varying the value of a coefficient in response to the output from an exhaust gas ingredient concentration detecting means which is arranged in the exhaust system of the engine, so as to attain a theoretical air/fuel ratio or a value close thereto (closed loop control), whereas while the engine is operating in one of particular operating conditions (e.g. an idling region, a mixture-leaning region, a wide-open-throttle region, and a fuel-cut effecting region), the air/fuel ratio is controlled in open loop mode by the use of a mean value of values of the above coefficient applied during the preceding feedback control, together with an exclusive coefficient corresponding to the kind of operating region in which the engine is then operating, thereby preventing any deviation of the air fuel ratio from a desired air/fuel ratio due to variations in the performance of various engine operating condition sensors and a system for controlling or driving the fuel injection device, etc. and/or due to aging changes in the performance of the sensors and the system, and also achieving required air/fuel ratios best suited for the respective particular operating conditions, to thus reduce the fuel consumption as well as improve the driveability of the engine.

However, even with the above method of applying a mean value of values of the feedback control correction coefficient to air/fuel ratio control in such particular operating regions, the resulting air/fuel ratios can sometimes be largely deviated from respective desired air/fuel ratios during operation of the engine in these particular operating regions, because there are some differences in operating condition of the engine between the feedback control region and the particular operating regions, which makes it difficult to control the air/fuel ratio so as to optimize the emission characteristics, fuel consumption, etc. of the engine throughout all the particular operating regions. Further, when the engine is operating in such particular operating regions, particularly in the idling region, the engine can have its emission characteristics and fuel consumption rate largely affected even by a small change in the air/fuel ratio of the mixture supplied to the engine, thereby requiring strict and accurate control of the air/fuel ratio during operation of the engine in these particular operating regions, especially in the idling region.

SUMMARY OF THE INVENTION

It is the object of the invention to provide a fuel supply control method for an internal combustion engine, in which while the engine is operating in any of particular operating regions other than the feedback control region, a correction coefficient is applied to the air/fuel ratio control, which has an exclusive value optimal to the particular operating region in which the engine is operating, so as to achieve an air/fuel ratio closer to a desired air/fuel ratio for the same particular operating region, thereby improving the operational stability of the engine as well as the emission characteristics and fuel consumption of same.

The present invention provides a fuel supply control method for electronically controlling the air/fuel ratio of an air/fuel mixture being supplied to an internal combustion engine, in response to an output from an exhaust gas ingredient concentration detecting means, the method being characterized by comprising the following steps: (1) determining an operating region in which the engine is operating, including a feedback control region and a plurality of predetermined particular operating regions other than the feedback control region; (2) applying a first coefficient which is variable in value in response to the output from the exhaust gas ingredient concentration detecting means, to control of the air/fuel ratio, and simultaneously determining a mean value of values of the first coefficient applied during the same feedback air/fuel ratio control, for use as a second coefficient, when it is determined in the step (1) that the engine is operating in the above feedback control region; (3) applying the above second coefficient in place of the first coefficient to the air/fuel ratio control, when it is determined in the step (1) that the engine is operating in a first one of the particular operating regions; and (4) applying a predetermined value in place of the first coefficient, to the air/fuel ratio control, when it is determined in the step (1) that the engine is operating in a second one of the particular operating regions other than the first one particular operating region.

Preferably, the above first one particular operating region includes a mixture-leaning region, while the second one particular operating region includes an operating region mmediately following the start of the engine, in which the sensor element of the exhaust gas ingredient concentration detecting means is not yet activated enough to properly detect the exhaust gas ingredient concentration, an idling region, a wide-open-throttle region, a predetermined low engine speed open loop control region, and a predetermined high engine speed open loop control region.

Also, preferably, when it is determined in the above step (1) that there occurs a transition of the operating condition of the engine from one of the particular operating regions to the feedback control region, the air/fuel ratio feedback control is initiated by the use of a second predetermined value other than the first-mentioned predetermined value, preferably the above second coefficient value, as an initial control value, in place of the first coefficient, and thereafter the same feedback control is effected by the use of the value of the first coefficient responsive to the output from the exhaust gas ingredient concentration detecting means. Further, preferably, when the engine is operating in the above second one particular operating region, particularly in the idling region, the air/fuel ratio of the mixture is further corrected by the value of a correction variable corresponding to an output voltage supplied from a variable voltage creating means which is settable at human will.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
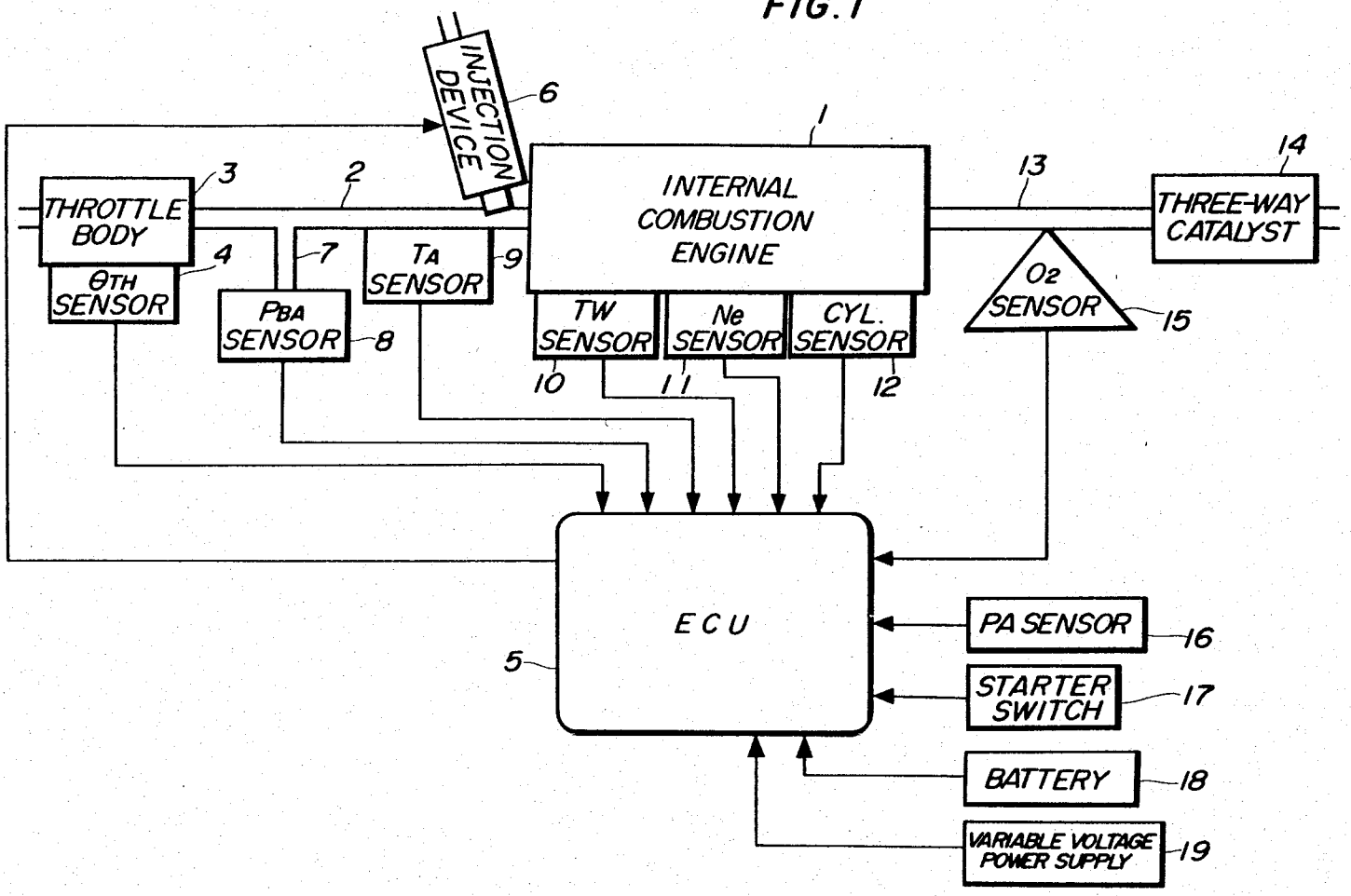
FIG. 1 is a block diagram illustrating the whole arrangement of a fuel supply control system to which is applicable the method according to the invention.

Referring first to FIG. 1, there is illustrated the whole arrangement of a fuel supply control system for internal combustion engines, to which the method according to the invention is applicable. Reference numeral 1 designates an internal combustion engine which may be a four-cylinder type, for instance. An intake pipe 2 is connected to the engine 1, in which is arranged a throttle valve 3, which in turn is coupled to a throttle valve opening sensor 4 for detecting its valve opening and converting same into an electrical signal which is supplied to an electronic control unit (hereinafter called "ECU") 5.

Fuel injection valves 6 are arranged in the intake pipe 2 at a location between the engine 1 and the throttle valve 3, which correspond in number to the engine cylinders and are each arranged at a location slightly upstream of an intake valve, not shown, of a corresponding engine cylinder. These injection valves are connected to a fuel pump, not shown, and also electrically connected to the ECU 5 in a manner having their valve opening periods or fuel injection quantities controlled by signals supplied from the ECU 5.

On the other hand, an absolute pressure sensor (PBA sensor) 8 communicates through a conduit 7 with the interior of the intake pipe at a location immediately downstream of the throttle valve 3. The absolute pressure sensor 8 is adapted to detect absolute pressure in the intake pipe 2 and applies an electrical signal indicative of detected absolute pressure to the ECU 5. An intake air temperature sensor 9 is arranged in the intake pipe 2 at a location downstream of the absolute pressure sensor 8 and also electrically connected to the ECU 5 for supplying thereto an electrical signal indicative of detected intake air temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rotational angle position sensor 11 and a cylinder-discriminating sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starter switch 17 for actuating the engine starter, not shown, of the engine 1, respectively, for supplying an electrical signal indicative of detected atmospheric pressure and an electrical signal indicative of its own on and off positions to the ECU 5.

Further electrically connected to the ECU 5 are a battery 18 and a variable voltage power supply 19 for adjusting the idling operation of the engine, which supply the ECU 5 with a supply voltage for operating the ECU 5 and a voltage VIDL for correcting the air/fuel ratio during idling operation of the engine, hereinafter described, respectively.

The ECU 5 operates in response to various engine operation parameter signals as stated above, to determine operating conditions in which the engine is operating, such as a fuel cut operating region, etc. and to calculate the fuel injection period of the fuel injection valves 6, which is given by the following equation, in accordance with the determined operating conditions of the engine and in synchronism with generation of pulses of the TDC signal:

$$TOUT = Ti \times (KTA \times KTW \times KWOT \times KLS \times KDR \times KCAT \times KO_2) + TIDL \quad (1)$$

where Ti represents a basic value of the fuel injection period of the fuel injection valves 6, which is determined by engine rpm Ne and intake pipe absolute pressure PBA, and KTA an intake air temperature-dependent correction coefficient and KTW an engine temperature-dependent correction coefficient, which have their values determined by intake air temperature TA and engine cooling water temperature TW, respectively. KWOT, KLS and KDR are correction coefficients having constant values, of which KWOT is a mixture-enriching coefficient applicable at wide-open-throttle operation, KLS a mixture-leaning coefficient applicable at mixture-leaning operation, and KDR a mixture-enriching coefficient applicable at operation of the engine in a low engine speed open loop control region which the engine passes while it is being rapidly accelerated from the idling region, for the purpose of improving the driveability of the engine in such operating condition. KCAT is a mixture-enriching coefficient applicable at engine operation in a high engine speed open loop control region, for the purpose of preventing burning of the three-way catalyst 14 in FIG. 1. This coefficient KCAT is set to larger values as the engine load increases. TIDL is a correction variable for correcting the fuel injection period of the fuel injection valves 6, and has its value determined by a preset voltage supplied to the ECU 5 from the idling adjusting variable voltage power supply 19 in FIG. 1, which is adjusted so as to adapted a fuel supply control system employing the method of the invention to the operating characteristics of an engine to be applied. The value of this variable TIDL is set in the stage of assemblage of each fuel supply control system, for incorporation into an engine, or at periodical inspection of the same system for maintenance purposes, etc. To be concrete, while the engine is made to operate in an idling state, the value of the variable TIDL is set to such a value as to obtain a value of the fuel injection period of the fuel injection valves 6 which corresponds to a predetermined air/fuel ratio optimal to the idling operation of the engine. Practically, a voltage changing element, for instance, a variable resistor, is adjusted so as to provide a voltage VIDL corresponding to the desired air/fuel ratio, and the voltage VIDL thus obtained is converted into a digital value TIDL, by an analog-to-digital converter within the ECU 5. Since the air/fuel ratio has to be strictly controlled with high accuracy during operation of the engine in the idling region, as previously noted, usually this correction variable TIDL is applied only when the engine is idling. However, similar correction variables may be applied not only to the idling region but also to other suitable operating regions or throughout all the operating regions of the engine. In the equation (1), $KO_2$ represents an $O_2$ sensor output-dependent correction coefficient, the value of which is determined in response to the oxygen concentration in the exhaust gases during engine operation in the feedback control region, in a manner shown in FIG. 3. On the other hand, this correction coefficient $KO_2$ has its value set to and held at respective predetermined values during engine operation in other or particular operating conditions wherein the feedback control is not effected.

The ECU 5 operates on the value of the fuel injection period TOUT determined as above to supply corresponding driving signals to the fuel injection valves 6.

Figure 2:
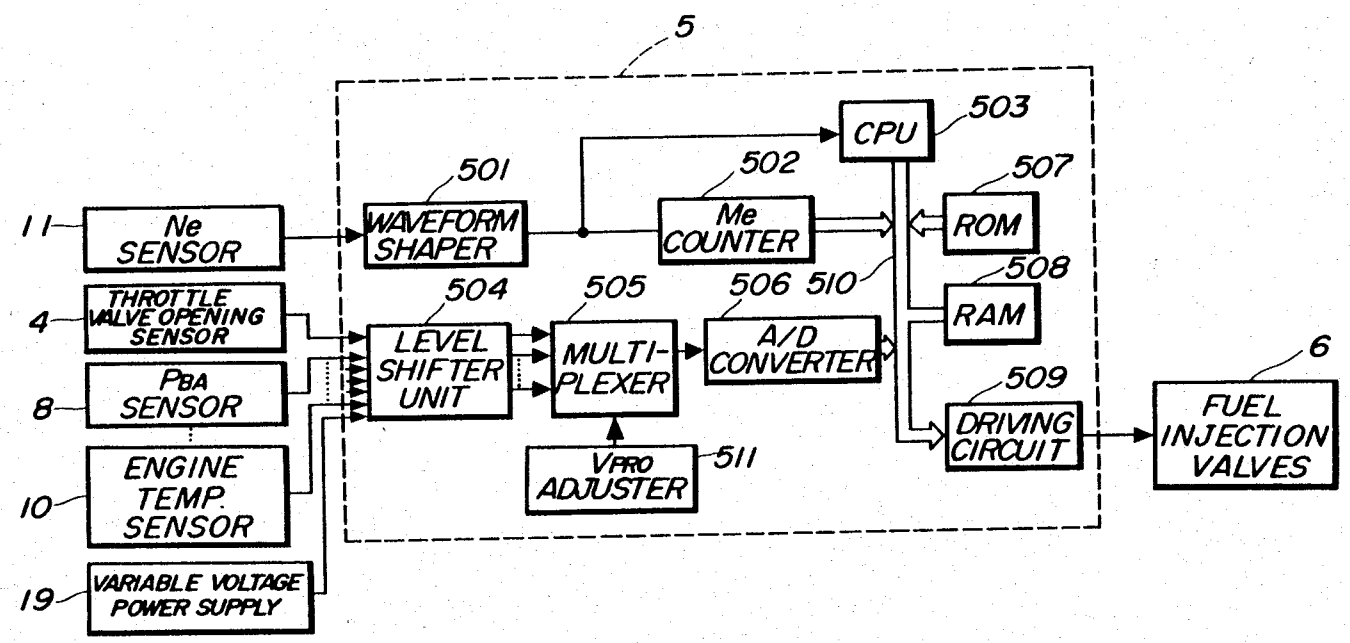
FIG. 2 is a block diagram illustrating the internal arragement of an electronic control unit (ECU) appearing in FIG. 1.

FIG. 2 shows a circuit configuration within the ECU 5 in FIG. 1. An output signal from the engine rotational angle position sensor 11 is applied to a waveform shaper 501, wherein it has its pulse waveform shaped, and supplied to a central processing unit (hereinafter called "CPU") 503, as the TDC signal, as well as to an Me value counter 502. The Me value counter 502 counts the interval of time between a preceding pulse of the TDC signal generated at a predetermined crank angle of the engine and a present pulse of the same signal generated at the same crank angle, inputted thereto from the engine rotational angle position sensor 11, and therefore its counted value Me corresponds to the reciprocal of the actual engine rpm Ne. The Me value counter 502 supplies the counted value Me to the CPU 503 via a data bus 510.

The respective output signals from the throttle valve opening sensor 4, the intake pipe absolute pressure PBA sensor 8, the engine coolant temperature sensor 10, etc. have their voltage levels successively shifted to a predetermined voltage level by a level shifter unit 504 and applied to an analog-to-digital converter 506 through a multiplexer 505. The output voltage VIDL from the idle adjusting variable voltage power supply 19 is also supplied to the level shifter unit 504 to be changed into a predetermined voltage level thereby. Also connected to the multiplexer 505 is a VPRO value adjuster 511 which supplies the analog-to-digital converter 506 through the multiplexer 505 with an adjusted voltage VPRO determining the value of a correction coefficient KPRO applied during engine operation in certain particular operating regions, as hereinafter described. This VPRO value adjuster 511 comprises a second variable voltage supply circuit formed of voltage dividing resistances or the like and preferably, connected to a constant voltage-regulator circuit, not shown. The analog-to-digital converter 506 successively converts into digital signals analog output voltages from the aforementioned various sensors, the variable voltage power supply 19 and the VPRO value adjuster 511, and the resulting digital signals are supplied to the CPU 503 via the data bus 510.

Further connected to the CPU 503 via the data bus 510 are a read-only memory (hereinafter called "ROM") 507, a radom access memory (hereinafter called "RAM") 508 and a driving circuit 509. The RAM 508 temporarily stores various calculated values from the CPU 503, while the ROM 507 stores a control program executed within the CPU 503 as well as maps of a basic fuel injection period Ti for fuel injection valves 6, which have values read in dependence on intake pipe absolute pressure and engine rpm, and correction coefficient maps, etc. The CPU 503 executes the control program stored in the ROM 507 to calculate the fuel injection period TOUT for the fuel injection valves 6 in response to the various engine operation parameter signals and the parameter signals for correction of the fuel injection period, and supplies the calculated value of fuel injection period to the driving circuit 509 through the data bus 510. The driving circuit 509 supplies driving signals corresponding to the above calculated TOUT value to the fuel injection valves 6 to drive same.

Figures 3, 3B:
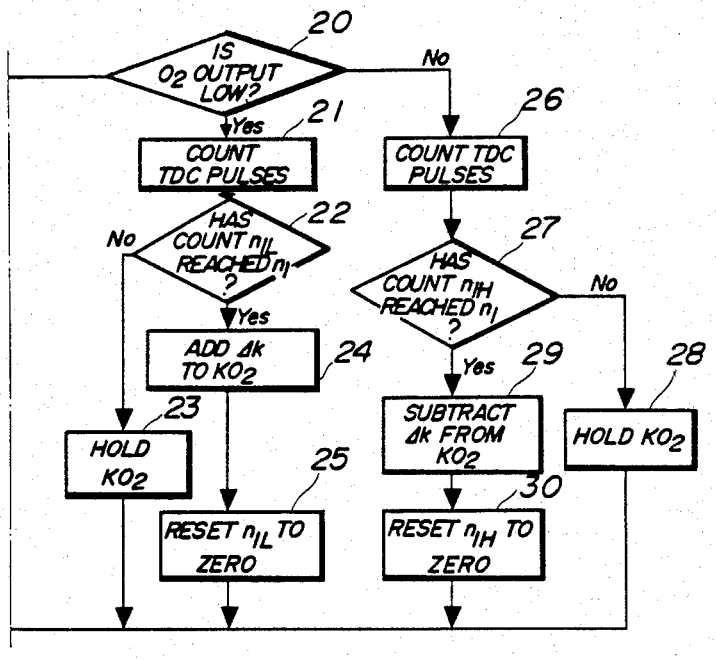
FIGS. 3, 3*a* and 3*b* are a flow chart of a manner of executing the method according to the invention.
Figure 3A:
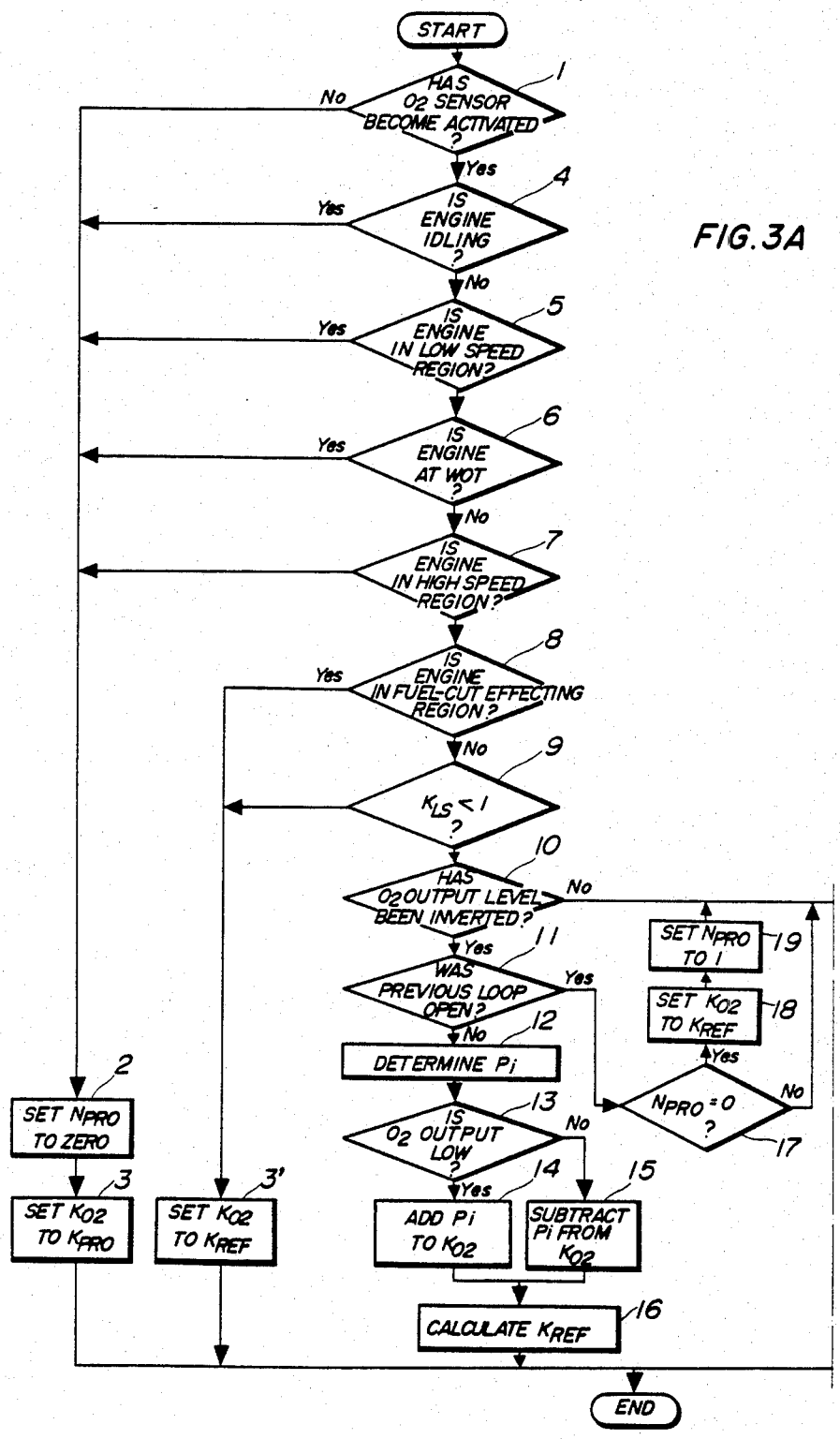

Referring next to FIG. 3, there is shown a flow chart of the method according to the invention. First, a determination is made as to whether or not the $O_2$ sensor has become activated, at the step 1. More specifically, by utilizing the internal resistance of the $O_2$ sensor, it is detected whether or not the output voltage of the $O_2$ sensor has dropped to an initial activation point VX (e.g. 0.6 volt). Upon the point VX being reached, an activation-indicative signal is generated which actuates an associated activation delay timer to start counting a predetermined period of time (e.g. 60 seconds). At the same time, whether or not the engine cooling water temperature-dependent correction coefficient KTW assumes a value of 1 is also determined. If these conditions are fully satisfied, it is judged that the activation of the $O_2$ sensor has been completed. If the answer to the question of the step 1 is negative, the value of a flag signal NPRO indicative of whether or not the coefficient KPRO is applied is set to 0, at the step 2, and simultaneously the coefficient $KO_2$ is replaced by the coefficient KPRO, at the step 3. The coefficient KPRO is applied during deactivation of the $O_2$ sensor, or while the engine is operating in any of particular operating regions including the idling region, the wide-open-throttle region, as well as a low engine speed open loop control region and a high engine speed open loop control region. Depending upon the kinds of such particular operating regions, the coefficient KPRO is applied alone or together with other coefficents proper to individual operating regions, so as to achieve desired air/fuel ratios optimal to the respective particular operating regions. To this end, the value of the coefficietn KPRO is preferably set to 1.0 or a value approximate thereto. In the above specified particular operating regions, the engine can undergo rather different operating conditions than in the feedback control region wherein a mean value KREF of the coefficient $KO_2$ is calculated, as hereinafter referred to. Therefore, if the mean value KREF is directly applied to engine operation in these particular operating regions, ther resulting air/fuel ratios can be largely deviated from the respective desired values. To eliminate such diadavantage, according to the invention, the coefficient KPRO is applied in place of the mean value KREF, during engine operation in these particular operating regions. More specifically, for each lot of engines on the production line, an appropriate value of the coefficient KPRO is determined which can achieve desired air/fuel ratios which enable attainment of operating characteristics of each engine such as driveability, emission characteristics and fuel consumption during operation of the engine in the above specified particular operating regions, and then the output voltage VPRO from the VPRO value adjuster 511 in FIG. 2 is adjusted by selecting the value of a resistance of the VPRO value adjuster 511 at a value corresponding to the value of the coefficient KPRO thus determined.

In addition, the value of the coefficient KPRO is set to an appropriate value and stored in an ECU 5 in a fuel supply control system employing the method of the invention when the same control system is mounted onto an engine, so as to apply the coefficient value for initiation of the air/fuel ratio control as an initial value, in place of the mean value KREF of the coefficient $KO_2$. This is because the mean value KREF is obtained on the basis of values of the coefficient $KO_2$ during past operation of the engine and therefore not yet obtained at the shipment of engines. More specifically, the value KPRO is applied in place of the mean value KREF, first, for use as an initial value for calculation of the same mean value KREF which is effected for the first time during a first operation of a fuel supply control system to which is aplied the method of the invention, that is, in the first feedback control operation of the same system, and secondly, for use as a substitute correction coefficient for the air/fuel ratio control during engine operation in a corresponding particular operating region (i.e. the mixture-leaning region or the fuel-cut effecting region) which takes place for the first time during a first operation of the above system. For example, in the first calculation of the mean value KREF, the value KPRO is substituted into an equation (2), hereinafter referred to, for calculation of the mean value KREF, in place of the term KREF′ thereof.

Figure 4:
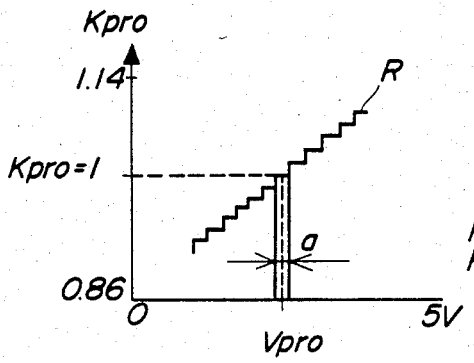
FIG. 4 is a graph showing a manner of setting the value of a correction coefficient KPRO in dependence on a value VPRO.

FIG. 4 shows an example of setting the value of coefficient KPRO in relation to the VPRO value. The value R of the above resistance of the VPRO value adjuster 511 is selected at a value corresponding to the value of coefficient KPRO which is previously determined as stated above. In most engines, the value KPRO is set to a standard value of 1, but advantageously, depending upon the operating characteristics, etc. of an engine to be applied, the value KPRO is set to values within a range of ±14% with respect to the standard value of 1. Further advantageously, a predetermined tolerance margin a is given to the VPRO value so as to avoid any deviation from the value KPRO already set, due to variations in the VPRO value once the latter is set. Although in the example of FIG. 4 a plurality of fixed resistances are employed, which are selected for setting the VPRO value, a variable resistance may of course be employed instead.

Figure 5:
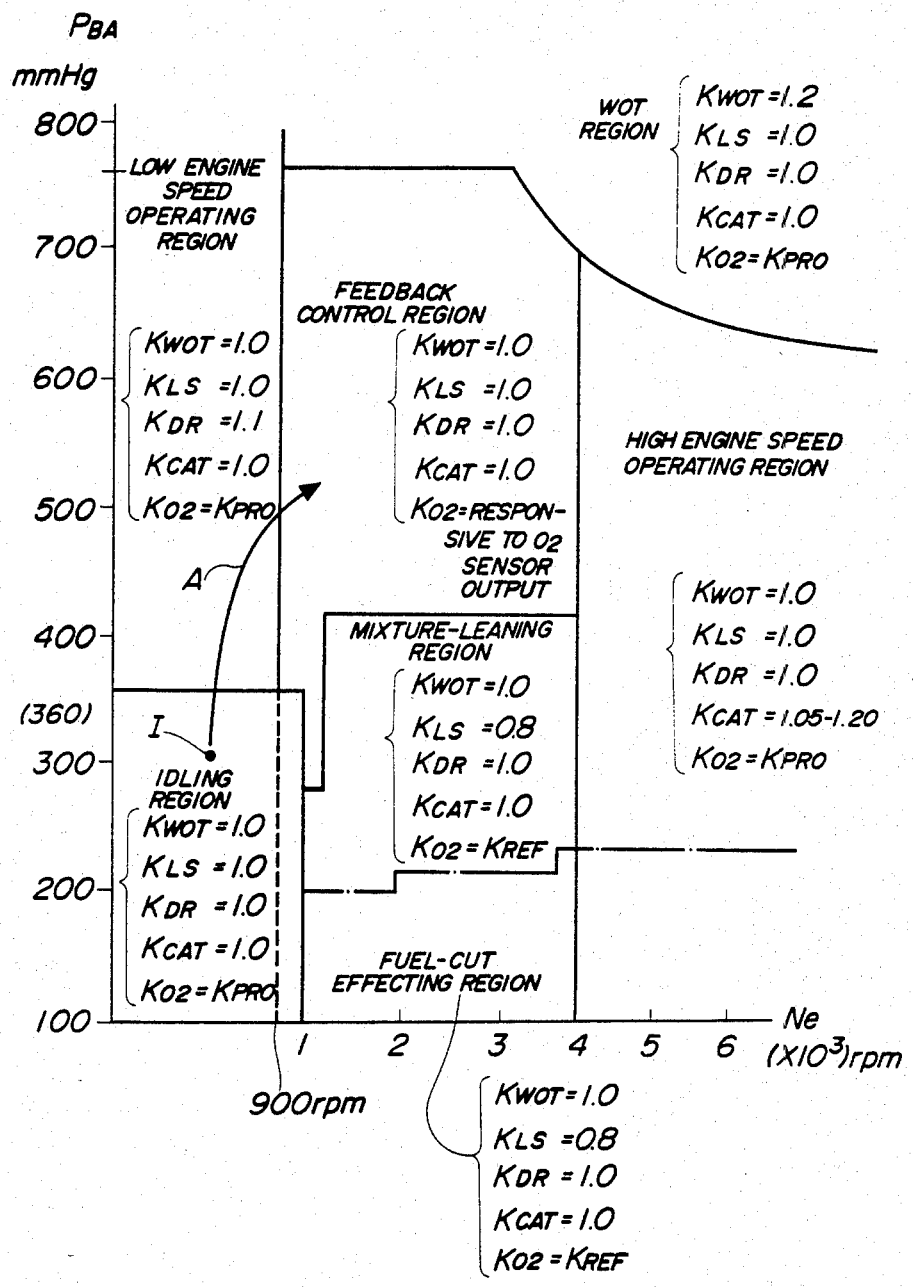
FIG. 5 is a graph showing a manner of applying various correction coefficients to various operating regions of the engine.

Reverting again to FIG. 3, if the answer to the question of the step 1 is yes, it is then determined at the step 4 whether or not the engine is idling, for instance, whether or not the engine rpm Ne is smaller than predetermiend rpm NIDL (e.g. 1,000 rpm) and at the same time the intake pipe absolute pressure PBA is lower than a predetermined value PBIDL (e.g. 360 mmHg). If the answer to the question of the step 4 is yes, the coefficient $KO_2$ is superseded by the coefficient KPRO at the steps 2 and 3. On the other hand, if the answer is negative, whether or not the engine is operating in the aforementioned low engine speed open loop control region is determined at the step 5. The manner of application of the coefficients to various operating regions of the engine is shown in FIG. 5 which is a graph plotting various operating regions of the engine defined by engine rpm Ne and intake pipe absolute pressure PBA. As shown in FIG. 5, the low engine speed open loop conrol region is defined as a region where the engine rpm Ne is smaller than predetermined rpm (e.g. 900 rpm) slightly higher than idling rpm where the throttle valve is in its idling or substantially fully closed position (e.g. 650–700 rpm) and the intake pipe absolute pressure PBA is higher than a predetermined upper limit of the idling region (e.g. 360 mmHg). While the engine is operating in this region, the coefficient KPRO is applied in lieu of the coefficient $KO_2$, through the steps 2 and 3 in FIG. 3. The reason for the application of the coefficient KPRO in this low engine speed open loop control region is that when the engine is accelerated from its idling state having the idling point I of 650–750 rpm for instance, the engine usually passes through the above low engine speed open loop control region as indicated by the line A in FIG. 5, and if during passing of the engine in this region the feedback control of the air/fuel ratio is effected, the resultant air/fuel ratio has a predetermined or theoretical value (14.7) or its approximate values, impeding attainment of required driveability of the engine. Therefore, according to the invention, while the engine is travelling in this region, the air/fuel ratio control is effected in open loop mode wherein the mixture-enriching coefficient KDR having a value of 1.1 for instance is applied as a proper coefficient, and at the same time the coefficient KPRO is applied in place of the coefficient $KO_2$ so as to enrich the air/fuel ratio, thereby enhancing the driveability of the engine during acceleration from the idling region.

In FIG. 3, if as a result of the determination at the step 5 it is found that the engine is not in the above low engine speed open loop control region, whether or not the engine is in the wide-open-throttle region is determined on the basis of the throttle valve opening th and the intake pipe absolute pressure PBA, at the step 6. If it is found that the engine is in the wide-open-throttle region, the coefficient KPRO is applied in place of the coefficient $KO_2$, at the steps 2 and 3, whereas if it is found that the engine is not in the same region, it is then determined at the step 7 whether or not the engine is in the high engine speed open loop control region. This region is defined as a region wherein the engine rpm Ne is within a predetermined high rpm range (e.g. larger than 4,000 rpm), as shown in FIG. 5. If the air/fuel ratio is controlled in feedback mode to a theoretical value (14.7) or values close thereto while the engine is operating in this predetermined high rpm range, the resultant exhaust gas temperature will increase so that the bed temperature of the three-way catalyst in FIG. 1 increases above its allowable upper limit, resulting in thermal damage or burning of the catalyst. Therefore, according to the invention, when the engine is operating in such high rpm range, the air/fuel ratio control is effected in open loop mode, wherein the correction coefficient (mixture-enriching coefficient) KCAT having a value set to a range within 1.05 to 1.2 for instance is applied, as well as the correction coefficient KPRO in place of the coefficient $KO_2$, at the steps 2 and 3, so as to enrich the mixture, thereby reducing the oxygen concentration in the exhaust gases for prevention of burning of the three-way catalyst. The value of the mixture-enriching coefficient KCAT is set to larger values as the intake pipe absolute presssure PBA increases, that is, as the engine load become increases. At the step 7, if the answer is yes, the coefficient $KO_2$ is replaced by the coefficient KPRO, as noted above, whereas if the answer is no, whether or not the engine is in the fuel-cut effecting condition is determined depending upon the intake pipe absolute pressure and the engine rpm, at the step 8. If the answer to the question of the step 8 is yes, that is, if the fuel-cut effecting condition is fulfilled, a mean value KREF of values of the coefficient $KO_2$ applied during the preceding feedback control operation is applied in place of the coefficief $KO_2$, at the step 3'. On the other hand, if it is determind that the engine is not operating in the fuel-cut effecting region, it is then determined whether or not the orrection coefficient KLS for the mixture-leaning region is smaller than 1, that is, whether or not the engine is operating in the mixture-leaning region defined by the intake pipe absolute pressure and the engine rpm, at the step 9. If the answer is yes, the mean value KREF is applied in place of the coefficient $KO_2$, at the step 3'. As described hereinafter, since the fuel-cut effecting region and the mixture-leaning region are rather close in operating condition of the engine to the feedback control region, respective predetermined air/fuel ratios can be obtained by setting the coefficient $KO_2$ to the mean value KREF, as above.

Figure 6:
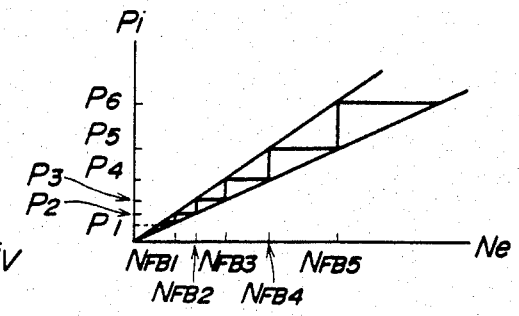
FIG. 6 is a view showing an Ne-Pi table for determining a correction value Pi for a correction coefficient $KO_2$.

If the answer to the above question of the step 9 is negative, the program proceeds to execution of closed loop control of the air/fuel ratio, as described below. First, it is determined whether or not there occurs an inversion in the output level of the $O_2$ sensor, at the step 10. If the answer is yes, a determination is made as to whether or not the preceding loop was an open loop mode, at the step 11. If it is determined that the preceding loop was not an open loop, a proportional term control (P-term control) operation is executed. More specifically, referring to FIG. 6 showing an Ne - Pi table for determining a correction amount Pi by which the coefficient $KO_2$ is corrected, five different predetermined Ne values $NFB_{1-5}$ are provided which has values falling within a range from 1500 rpm to 3500 rpm, while six different predetermined Pi values $P_{1-6}$ are provided in relation to the above Ne values, by way of example. Thus, the value of correction amount Pi is determined from the engine rpm Ne at the step 12, which is added to or subtracted from the coefficient $KO_2$ upon each inversion of the output level of the $O_2$ sensor. Then, whether or not the output level of the $O_2$ sensor is low is determined at the step 13. If the answer is yes, the Pi value obtained from the table of FIG. 6 is added to the coefficient $KO_2$, at the step 14, while if the answer is no, the former is subtracted from the latter at the step 15. Then, a mean value KREF corresponding to the present operation of the engine in the feedback control region, is calculated from the value of $KO_2$ thus obtained, at the step 14. Calculation of the mean value KREF can be made by the use of the following equation:

$$KREF = \frac{CREF}{A} \times KO_2p + \frac{A - CREF}{A} \times KREF \qquad (2)$$

where $KO_2p$ represents a value of $KO_2$ obtained immediately before or immediately after a proportional term (P-term) control action, A a constant (e.g. 256), CREF a variable which is experimentally determined and set within a range from 1 to A−1, and KREF' a mean value of values $KO_2$ obtained from the start of the first operation of an associated control circuit to the last proportional term control action inclusive.

Since the value of the variable CREF determines the ratio of the value $KO_2p$ obtained at each P-term control action, to the value KREF, an optimum value KREF can be obtained by setting the value CREF to a suitable value within the range from 1 to A−1 depending upon the specifications of an air/fuel ratio control system, an engine, etc. to which the invention is applied.

Figure 7:
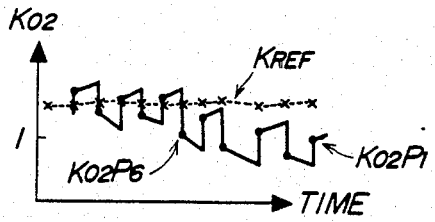
FIG. 7 is a graph showing a manner of detecting the value of a correction coefficient $KO_2p$ during proportional term control.

FIG. 7 is a graph showing a manner of detecting (calculating) the value $KO_2p$ at an instant immediate after each P-term control action. In FIG. 7, the mark · indicates a value $KO_2p$ detected immediately after a P-term control action, and $KO_2p1$ is an up-to-date value detected at the present time, while $KO_2P6$ is a value detected immediately after a P-term control action which is a sixth action from the present time.

The mean value KREF can also be calculated from the following equation, in place of the aforementioned equation (2):

$$KREF = \frac{1}{B} \sum_{j=1}^{B} KO_2pj \quad (3)$$

where $KO_2pj$ represents a value of $KO_2p$ obtained immediately before or immediately after a jth P-term control action before the present one, and B a constant which is equal to a predetermined number of P-term control actions (a predetermined number of inversions of the $O_2$ sensor output) subjected to calculation of the mean value. The larger the value of B, the larger the ratio of each value $KO_2p$ to the value KREF becomes. The value of B is therefore set at a suitable value depending upon the specifications of an air/fuel ratio feedback control system, an engine, etc. to which the invention is applied. According to the equation (3), calculation is made of the sum of the values of $KO_2p$ from the P-term control action taking place B times before the present P-term control action to the present P-term control action, each time a value of $Ko_2pj$ is obtained, and the mean value of these values of $Ko_2pj$ forming the sum is calculated.

Referring again to FIG. 3, when the answer to the question of the step 11 is yes, that is, when the preceding loop was an open loop, it is determined whether or not the aforementioned flag signal NPRO assumes 0, at the step 17. If the answer is yes, that is, if the coefficient PRO was applied in the open loop control in the preceding loop, a predetermined value, preferably, a mean value KREF of values of the coefficient $KO_2$ obtained during the preceding feedback control is applied as an initial coefficient value during the present loop feedbck control, that is, the value of the coefficient $KO_2$ is set to the mean value KREF, at the step 18. At the same time, the value of the flag signal NPRO is set to 1 at the step 19, followed by the program proceeding to the step 20. In this manner, by applying a mean value KREF upon a transition to the feedback control region, an air/fuel ratio can quickly be attained, which is appropriate to the actual operating condition of the engine, thereby permitting smooth initiation of the air/fuel ratio control in the feedback control region, without spoiling the driveability and emission characteristics of the engine. If the answer to the question of the step 17 is negative, that is, if the mean value KREF was applied in place of the coefficient KPRO in the preceding loop open loop control, i.e. in the fuel-cut effecting region or in the mixture-leaning region, the program proceeds directly to the step 20. If the answer to the question of the step 10 is negative, that is, if the output of the $O_2$ sensor remains at the same level, or if the mean value KREF is applied in place of the coefficient $KO_2$ in the present loop feedback mode following open loop control in the preceding loop as a result of the determination of the step 17, integral term control (I-term control) is effected. More specifically, at the step 20 it is determined whether or not the output level of the $O_2$ sensor is low, and if the answer is yes, counting is made of pulses of the TDC signal at the step 21, while monitoring the number of TDC signal pulses counted to determine whether or not the count nIL has reached a predetermined number nI (e.g. 30 pulses), at the step 22. If the predetermined number nI has not been reached, the value of the coefficient $KO_2$ is held at an immediately preceding value, at the step 23, while if the predetermined number nI has been reached, a predetermined value $\Delta k$ (e.g. about 0.3% of the $KO_2$ value) is added to the $KO_2$ value, at the step 24. At the same time, the number of pulses nIL so far counted is reset to zero at the step 25. After this, the predetermined value $\Delta k$ is added to the $KO_2$ value each time the value nIL reaches the value nI. On the other hand, if the answer to the question of the step 20 is found to be no, TDC signal pulses are counted at the step 26, accompanied by determining whether or not the count nIH has reached the predetermined value nI at the step 27. If the answer is no at the step 27, the $KO_2$ value is held at its immediately preceding value, at the step 28, while if the answer is yes, the predetermined value $\Delta k$ is subtracted from the $KO_2$ value, at the step 29, and simultaneously the number of pulses nIH so far counted is reset to zero at the step 30. Then, the predetermined value $\Delta k$ is subtracted from the $KO_2$ value each time the value nIH reaches the value nI in the same manner as described above.

The correction coefficients KPRO, KREF, KWOT, KLS, KDR and KCAT are selectively applied and set to suitable values, depending upon the kinds of the operating regions in which the engine is operating. For example, while the $O_2$ sensor is in a deactivated state, the values of coeffcients KWOT, KLS, KDR and KCAT are all set to 1.0, and simultaneously the value of coefficient $KO_2$ is replaced by the value of KPRO, as noted previously. Further, as shown in FIG. 5, when the engine is operating in the wide-open-throttle region, the value of coefficient $KO_2$ is replaced by the value KPRO, while simultaneously the value of coefficient KWOT is set to 1.2 and the values of the other coefficients KLS, KDR, and KCAT are all set to 1.0. In the mixture-leaning region and in the fuel-cut effecting region, the value of coefficient $KO_2$ is replaced by a mean vakue KREF of values of the same coefficient $KO_2$ obtained during the immediately preceding feedback control, and simultaneously the value of coefficient KLS is set to 1.8 and the values of the other coefficients KWOT, KDR and KCAT to 0.8, respectively. In the idling region, the value of coefficient $KO_2$ is replaced by the value KPRO, while simultaneously the values of the other coefficients KWOT, KLS and KCAT are all set to 1.0. As hereinafter described, in the idling region, the fuel injection quantity is further corrected by the use of the aforementioned injection period correction variable TIDL. In the low engine speed open loop control region, the value of coefficient $KO_2$ is replaced by the value KPRO, and the value of coefficient KDR is set to 1.0, while simultaneously the values of the other coefficients KWOT, KLS and KCAT are all set to 1.0. In the high engine speed open loop control region, the value of coefficient $KO_2$ is replaced by the value KPRO, and the value of coefficient KCAT is set to a value within a range of 1.05 to 1.20, depending upon the magnitude of the engine load, while simultaneously the values of the other coefficients KWOT, KLS and KDR are all set to 1.0.

Figure 8:
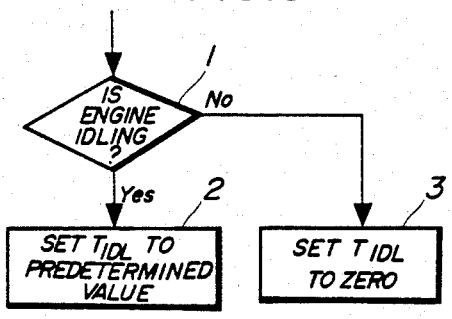
FIG. 8 is a flow chart showing a manner of applying a correction variable TIDL to the air/fuel ratio control during engine operation in the idling region.

Next, how to apply the correction variable TIDL for correcting the fuel injection period of the fuel injection valves to the engine operation in the idling region alone will now be explained with reference to FIG. 8. This variable TIDL is calculated by a background routine only while the engine is operating in the idling region. It is first determined whether or not the engine is operating in the idling region, at the step 1 in FIG. 8. If the answer is yes, a value of the variable TIDL which has been previously set is added to a fuel injection period Ti which has been corrected by the aforementioned correction coefficients, at the step 2. The value of the variable TIDL is set to a value within a range of −0.41 ms to +0.41 ms. If the answer to the question of the step 1 is no, that is, if the engine is operating in any other operating region than the idling region, the value of the variable TIDL is set to zero, so as not to execute the correction by this variable. Of course, the routine of FIG. 8 is not necessary if the correction by the variable TIDL is applied to the other operating regions besides the idling region as previously noted.

What is claimed is:

1. A method for electronically controlling the air/fuel ratio of an air/fuel mixture being supplied to an internal combustion engine having an intake passage, and a throttle valve arranged in said intake passage, in response to an output from means for detecting the concentration of an ingredient in exhaust gases emitted from said engine, the method comprising the steps of: (1) determining an operating region in which said engine is operating, including a feedback control region and a plurality of predetermined particular operating regions other than said feedback control region; (2) applying a first coefficient which is variable in value in response to the output from said exhaust gas ingredient concentration detecting means, for controlling the air/fuel ratio of the air/fuel mixture, and simultaneously determining a mean value of values of said first coefficient applied during the same air/fuel ratio control, for use as a second coefficient, when it is determined in the step (1) that said engine is operating in said feedback control region; (3) applying said second coefficient in place of said first coefficient for controlling the air/fuel ratio of the air/fuel mixture, when it is determined in the step (1) that said engine is operating in a first one of said predetermined particular operating regions; and (4) applying a predetermined value in place of said first coefficient, for controlling the air/fuel ratio of the air/fuel mixture, when it is determined in the step (1) that said engine is operating in a second one of said predetermined particular operating regions other than said first one predetermined particular operating region.

2. A method as claimed in claim 1, wherein said first one predetermined particular operating region includes an operating region in which the air/fuel ratio of the air/fuel mixture is controlled to a value leaner than a theoretical air/fuel ratio.

3. A method as claimed in claim 1, wherein said second one predetermined particular operating region includes at least one of the following operating regions:

(a) an operating region immediately following the start of said engine, in which said exhaust gas ingredient concentration detecting means has a sensor element thereof not activated enough to properly detect the concentration of said exhaust gas ingredient;

(b) an idling region;

(c) an operating region in which said throttle valve is in a substantially fully opened position; and (d) an operating region in which the rotational speed of said engine is higher than a predetermined value of engine rpm and absolute pressure in said intake passage is higher than a predetermined pressure which is higher than a range of absolute pressures which said engine can normally assume during idling thereof.

4. A method as claimed in claim 1, wherein said engine includes catalytic means for purifying exhaust gas ingredients, and said second one predetermined particular operating region includes an operating region in which the rotational speed of said engine is within a predetermined high rpm range in which range if the air/fuel ratio of the air/fuel mixture is set to a theoretical air/fuel ratio or ratios close thereto, said exhaust gas ingredient purifying means has a catalyst bed temperature higher than an allowable upper limit thereof.

5. A method as claimed in claim 1, including the step of applying said first-mentioned predetermined value in place of said second coefficient, for use as an initial value of said second coefficient for calculation of said second coefficient in said step (2) which is executed for the first time during a first operation of a fuel supply control system to which is applied the method.

6. A method as claimed in claim 1, including the step of applying said first-mentioned predetermined value in place of said second coefficient, in said step (3) which is executed for the first time during a first operation of a fuel supply control system to which is applied the method.

7. A method as claimed in claim 1, wherein said first-mentioned predetermined value is determined by an output voltage from second variable voltage creating means.

8. A method as claimed in claim 1, including the step of applying a second predetermined value other than said first-mentioned predetermined value as an initial value for initiating control of the air/fuel ratio of the air/fuel mixture, in place of said first coefficient, and thereafter applying said first coefficient having a value variable in response to the output from said exhaust gas ingredient concentration detecting means for further continuing the same air/fuel ratio control, when it is determined in the step (1) that there occurs a transition of the operating condition of said engine from one of said predetermiend particular operating regions to said feedback control.

9. A method as claimed in claim 8, wherein said second coefficient is used as said second predetermined value.

10. A method as claimed in claim 1, including the step of further correcting the air/fuel ratio of the air/fuel mixture, by a correction variable having corresponding to an output voltage from variable voltage creating means which is settable at human will.

11. A method as claimed in claim 10, wherein said correction of the air/fuel ratio dependent upon said correction variable is effected only when said engine is operating in said second one predetermined particular operating region.

12. A method as claimed in claim 11, wherein said second one predetermined operating region is an idling region.

* * * * *